US005252096A

United States Patent [19]

Okada

[11] Patent Number: 5,252,096

[45] Date of Patent: Oct. 12, 1993

[54] CONNECTOR

[75] Inventor: Hajime Okada, Yokkaichi, Japan

[73] Assignee: Sumitomo Wiring Systems, Ltd., Mie, Japan

[21] Appl. No.: 879,347

[22] Filed: May 7, 1992

[30] Foreign Application Priority Data

May 13, 1991 [JP] Japan ..... 3-33105[U]

[51] Int. Cl.[5] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,867,712 | 9/1989 | Kato et al. | 439/752 |
| 4,946,398 | 8/1990 | Takenouchi et al. | 439/595 |
| 4,946,399 | 8/1990 | Kawashima | 439/752 |
| 5,066,252 | 11/1991 | Kato et al. | 439/752 |
| 5,203,722 | 4/1993 | Kinoshita | 439/752 |

FOREIGN PATENT DOCUMENTS

| | | |
|---|---|---|
| 417655 | 3/1991 | European Pat. Off. . |
| 2209047 | 4/1989 | United Kingdom . |
| 221033 | 6/1989 | United Kingdom . |

*Primary Examiner*—Gary F. Paumen

*Attorney, Agent, or Firm*—Sughrue, Mion, Zinn, Macpeak & Seas

[57] ABSTRACT

A connector includes a retainer inserting portion concaved from the upper surface of a connector housing to the vicinity of the bottom surface thereof and from one side surface thereof to the other side surface thereof. A retainer, for locking a terminal, is removably inserted in to the retainer inserting portion; and a flexible main locking plate and a flexible temporary locking plate, longer than the main locking plate, are both disposed on at least one lateral side of the retainer. In this construction, the locking portion disposed in the lower end portion of the temporary locking plate is locked at a temporary locking position by one of lower edges disposed on the lower front and lower rear of the opening of the retainer inserting portion, and the locking portion disposed at the lower end portion of the locking plate is locked at a locking position by the other lower edge of the retainer inserting portion by pressing the retainer into the connector housing.

5 Claims, 6 Drawing Sheets

CONNECTOR

BACKGROUND OF THE INVENTION

1. Field of the Invention

The present invention relates to an electric connector having a mechanism for locking a terminal and more particularly to an electric connector, suitable for use in a wire harness of an automobile, in which a terminal mounted on a plurality of electric wires is inserted into each chamber for accommodating the terminal inside a housing so as to fix the terminal thereto.

2. Description of the Related Arts

Conventionally, various mechanisms for locking the terminal in an electric connector have been proposed. For example, a strip for locking the terminal integrated with a connector housing and a locking means installed in the connector housing are known.

In forming the locking mechanism integrated with the connector housing, a locking strip projects from the bottom surface or the upper surface of the terminal accommodating chamber of the connector housing so that the terminal is locked by the locking strip by the engagement between the locking strip and an opening or a shoulder formed on the terminal. However, the .locking effect of the locking strip is insufficient because the locking strip is comparatively small and may be damaged by the installation of the terminal in the terminal accommodating chamber or the removal of the terminal therefrom.

In order to overcome the above-described problem, the following mechanism is proposed. That is, independently or in combination of the locking strip formed in the connector housing, a locking means not integrated with the connector and consisting of a retainer or a pin is inserted into through-hole formed in the connector housing with the terminal accommodated in the connector housing. Then, the side surface of the locking means engages the shoulder of the terminal so as to lock the terminal in the connector housing.

For example, as shown in FIGS. 9 through 11, according to a connector disclosed in Japanese Patent Laid-Open Publication No. 64-54677, a though-hole 1*b* communicating with each terminal accommodating chamber 1*a* is formed in a connector housing 1 and pins 2 which are to be inserted downwardly into the through-hole 1*b* are provided. A locking arm 2*a* formed on each pin 2 elastically contacts a locking portion 3*a* formed on a terminal 3 inserted into the terminal accommodating chamber 1*a*.

A press-in type locking retainer (pin) not integrated with the connector housing is adopted in the above-described connector and other conventional connectors. That is, the retainer is pressed into the connector housing from the state as shown in FIG. 10 to the locking state as shown in FIG. 11. Therefore, it is difficult to determine whether or not the retainer has been inserted into the connector housing at a predetermined position.

Therefore, an operator may press the retainer into the connector housing, and although the retainer appears to be at the predetermined position the locking portion may be damaged. If the operator presses the locking portion with the terminal not at the predetermined position the locking portion is destroyed. In this case, it is impossible to repeatedly use the retainer. In addition, it is difficult to take out the retainer because of its configuration.

As shown in FIG. 10, the terminal is inserted into the connector housing and then mounted therein in a temporary locking state. Then, the terminal is inserted into the predetermined position. But the connector housing does not have a means for locking the retainer in the connector housing. Therefore, the retainer is shaken and as a result, the retainer or the connector housing may be damaged.

As shown in FIG. 9, according to the above-described conventional retainer, the upper end of the pin 2 to be inserted through a partitioning wall 1*c* disposed between terminal accommodating chambers 1*a* is connected with a connecting plate 2*b*, with the pins 2 being spaced from each other at a certain interval. That is, the retainer is comb-shaped. This configuration does not provide a high mechanical strength and it is difficult to form the comb-shaped retainer by molding. In addition, the pin 2 is very thin.

SUMMARY OF THE INVENTION

It is an object of the present invention to provide a connector, having a retainer for locking a terminal in a connector housing, which allows the retainer to be inserted easily, repaired, and easily molded and to have a high strength.

It is another .object of the present invention to provide a connector which allows an operator to detect that a terminal has been inserted into a predetermined position.

In accomplishing this and other objects of the present invention, there is provided a connector comprising: a retainer inserting portion concaved at the upper surface of a connector housing from one side surface thereof to the other side surface thereof; a retainer, for locking a terminal, removably inserted into the retainer inserting portion; and a flexible main locking plate and a flexible temporary locking plate, longer than the main locking plate, both disposed on at least one lateral side of the retainer. In this construction, the locking portion disposed in the lower end portion of the temporary locking plate is locked at a temporary locking position by one of the lower edges disposed on the lower front and lower rear of the opening of the retainer inserting portion, and the locking portion disposed at the lower end portion of the locking plate is locked at a locking position by the other lower edge of the retainer inserting portion by pressing the retainer into the connector housing.

Specifically, each of a plurality of terminal inserting chambers of the retainer communicates with a corresponding terminal inserting chamber of the connector housing at the temporary locking position, and the terminal inserting chambers of the retainer each having a locking projection, for locking the terminal, formed on the upper wall thereof are surrounded with a lattice-shaped frame; when the retainer is pressed downwardly to place the retainer at the locking position with the terminal inserted into the terminal accommodating chamber of the connector housing and that of the retainer, the locking projection locks a box projecting from the terminal.

More specifically, the temporary locking plate and the locking plate consisting of one piece is U-shaped and has a space therebetween. These locking plates are flexible in the direction in which they move toward each other or away from each other. Claws are formed in the lower end of these locking plates. The upper surface of each claw is flat. The claws are tapered to form lower locking portions. A locking projection is formed on the lower edge, of the retainer inserting portion which engages the locking projection.

Preferably, a repair projection which can be gripped with the retainer inserted into the connector housing is formed on the upper surface of the retainer.

According to the above construction, the retainer is inserted into the retainer accommodating portion of the connector housing and the locking portion disposed in the lower end portion of the temporary locking plate engages one of the lower edges of the retainer inserting portion. Then, the terminal is inserted into the terminal accommodating chamber of the connector housing and that of the retainer. Thereafter, the retainer at the temporary locking position is pressed downwardly so that the locking portion disposed in the lower end portion of the locking plate engages the other lower edge of the retainer inserting portion.

The claw is formed on the lower end portion of the temporary locking plate and the locking projection is formed on the lower edge, of the retainer inserting portion, which engages the locking projection. When the tapered surface of the temporary locking plate moves away from the locking projection of the retainer inserting portion, the temporary locking projection which has been flexed inwardly returns to the original posture and the lower end surface of the locking projection of the retainer inserting portion engages the claw, thus clicking.

The terminal inserting chambers of the retainer are surrounded with a lattice-shaped frame. Therefore, the retainer is rigid and can be easily molded.

The retainer can be easily removed from the retainer inserting portion because the repair projection is formed on the surface of the retainer.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
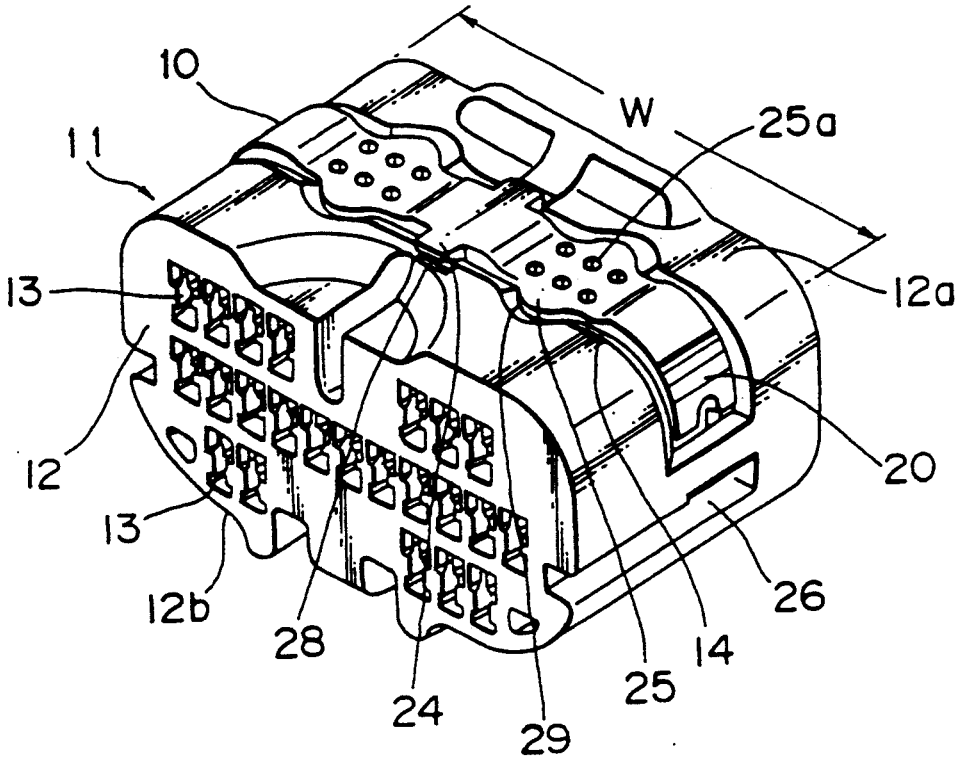
FIG. 1 is a perspective view showing a connector according to a first embodiment of the present invention.

Before the description of the present invention proceeds, it is to be noted that like parts are designated by like reference numerals throughout the accompanying drawings.

A first embodiment of the present invention is described below with reference to FIGS. 1 through 6.

FIGS. 1 through 6 show a male type connector 11 having a retainer 10 for preventing a terminal from being removed according to the first embodiment of the present invention.

As shown in FIG. 1, the connector 11 has, in a connector housing 12, a plurality of terminal accommodating chambers 13 disposed parallel with each other in three stage vertically arranged. The connector 11 has a retainer inserting portion 14, approximately rectangular, formed by concaving a part of the upper wall 12*a* of the connector housing 12 having a width of (W) downward to a neighborhood of a bottom wall 12*b* thereof.

Figure 2:
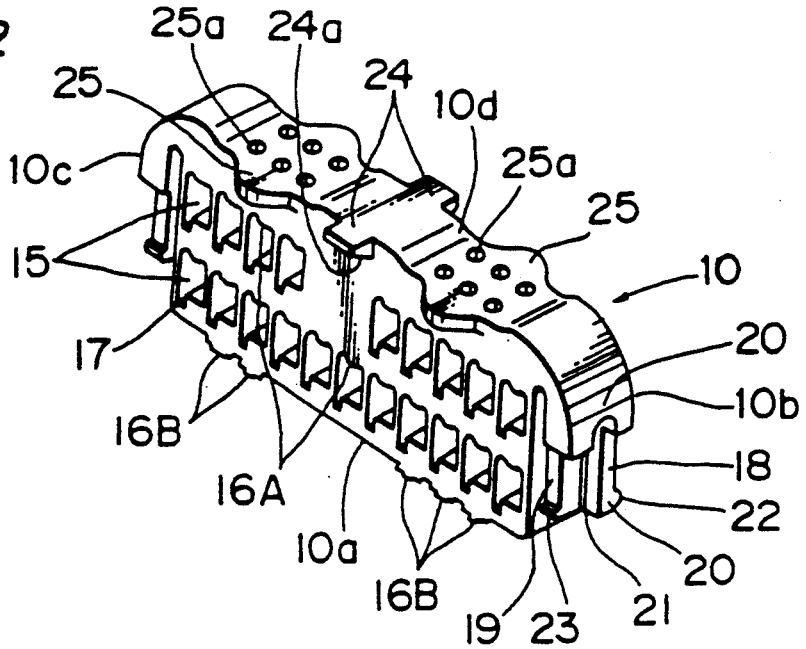
FIG. 2 is a perspective view showing a retainer according to the first embodiment of the present invention.

As shown in FIG. 2, the one-piece retainer 10, in the configuration of approximately a lattice-shaped frame, is fitted into the retainer inserting portion 14. The retainer 10 has a plurality of terminal accommodating chambers 15 penetrating therethrough in the front and rear direction thereof. Each terminal accommodating chamber 15 communicates with the corresponding terminal accommodating chamber 13 of the connector housing 12 when the retainer 10 is inserted into the connector housing 12. The terminal accommodating chambers 15 of the retainer 10 are formed in upper and lower stages so that the terminal accommodating chambers 15 of the upper stage and lower stage of the retainer 10 communicate with those of the upper stage and middle stage of the connector housing 12, respectively.

A locking projection 16A, for locking a terminal, projecting into the terminal accommodating chamber 15 is formed in the front of the upper wall of each terminal accommodating chamber 15. A locking projection 16B, for locking the terminal, projects downwardly from the bottom surface 10*a* of the retainer 10 corresponding to the terminal accommodating chamber 13 of the lower stage of the connector housing 12. A groove 17 for receiving a locking projection of a terminal is formed on one of the vertical walls of each terminal accommodating chamber 15.

Figure 4:
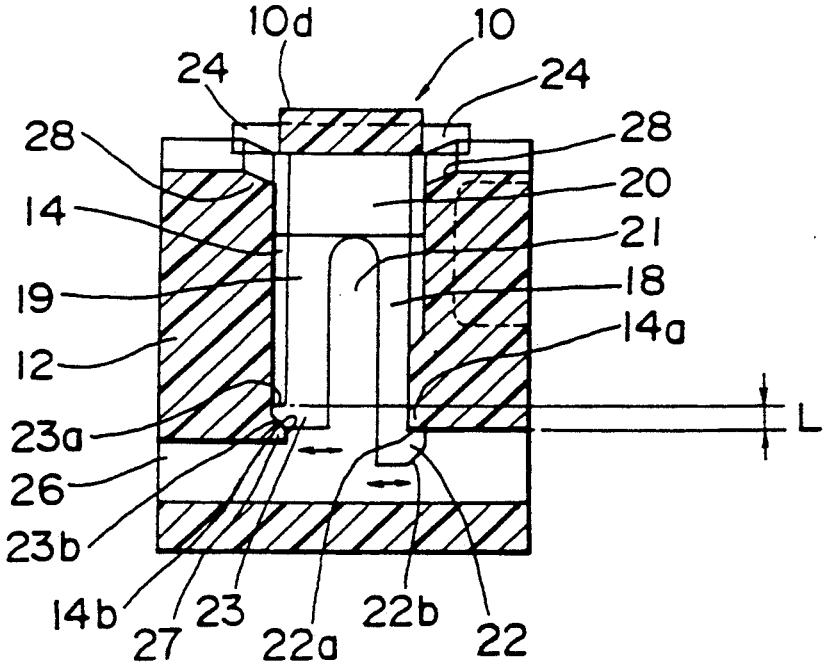
FIG. 4 is a sectional view showing a position for temporarily locking the connector according to the first embodiment of the present invention.

Referring to FIGS. 1, 2, and 4, a pair of U-shaped, one-piece locking plates 18 and 19 to be locked by the connector housing 12 projects downwardly from both side surfaces 10*b* and 10*c* of the retainer 10 so that the locking plates 18 and 19 are positioned below each curved upper wall 20 disposed on both sides of the retainer 10. As shown in FIG. 4, the locking plate 18 is longer than the locking plate 19 by (L). The locking plate 18 serves as a temporary locking plate. A space 21 is formed between the locking plates 18 and 19. The locking plates 18 and 19 are flexible in a direction shown, by an arrow of FIG. 4. Claws 22 and 23 are formed outwardly in the lower end of the locking plates 18 and 19, respectively. The upper surface of the claws 22 and 23 is flat and denoted as locking surfaces 22*a* and 23a. The claws 22 and 23 are tapered to form lower locking portions 22b and 23b.

A repair projection 24 positioned in the center of the upper surface 10d of the retainer 10 projects from both sides in front and rear direction thereof. The projection 24 can be gripped when the retainer 10 is in the connector housing 12. The tapered lower surface of the projection 24 is denoted by 24a. Slide-preventing portions 25 having a plurality of slide-preventing projections 25a formed thereon are disposed on both sides of the projection 24 of the retainer 10.

A groove 26 extending horizontally, below the retainer inserting portion 14, from the front of the connector housing 12 to a portion corresponding to the rear of the retainer inserting portion 14 is formed in a lower portion of both side surfaces of the connector housing 12 so that the groove 26 and the retainer inserting portion 14 communicate with each other. The locking plates 18 and 19 of the retainer 10 are locked by lower edges 14a and 14b, respectively disposed on the rear and front of the retainer inserting portion 14. A locking projection 27 is formed on the lower edge 14b which engages the locking projection 19.

As shown in FIGS. 1 and 4, an inclined repair projection locking surface 28 is formed in the center of each upper edge of the retainer inserting portion 14. A Locking surface 29 which contacts the slide-preventing portion 25 of the retainer 10 is formed on either side of the locking surface 28.

In the connector housing 12, a known means (not shown) which engages wire-attached terminal 30 inserted into the terminal accommodating chamber 13 is formed, thereby locking the terminal 30. The terminal 30 is locked by this means as well as the retainer 10.

The operation of the retainer of the connector is described below.

Figure 3:
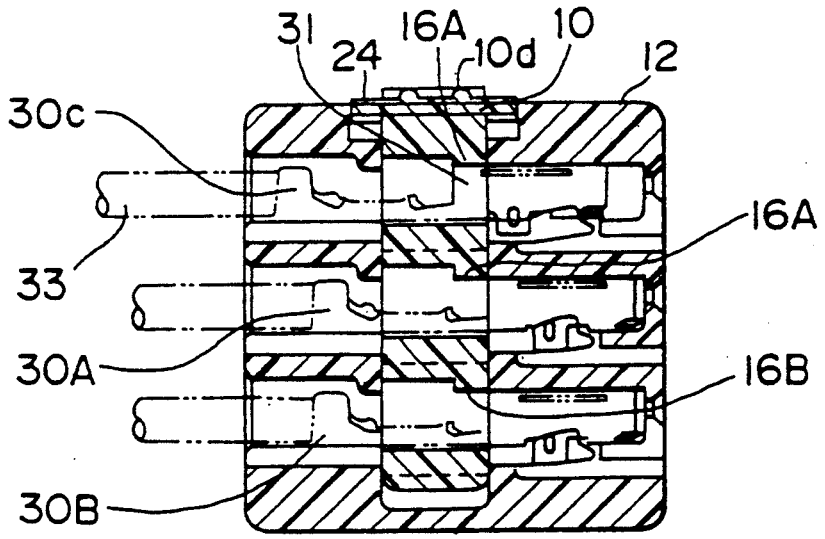
FIG. 3 is a sectional view showing a position for temporarily locking the connector according to the first embodiment of the present invention.

The retainer 10 is temporarily locked by the connector housing 12 before the terminal 30 is inserted into the terminal accommodating chamber 13 as shown in FIGS. 3 and 4. That is, the claw 22 of the locking plate 18 engages the lower edge 14a of the retainer inserting portion 14 so as to hold the retainer 10 at a temporary locking position while the locking plate 19 engages the upper surface of the locking projection 27 formed on the lower edge 14b of the retainer inserting portion 14.

In the temporary locking state, the upper surface 10d of the retainer 10 is a little upward from the upper surface of the connector housing 12, and each terminal accommodating chamber 15 of the retainer 10 communicates with the corresponding terminal accommodating chamber 13 of the connector housing 12 so that the terminal 30 can be smoothly inserted from the terminal accommodating chamber 13 into the terminal accommodating chamber 15.

When the terminal 30 is inserted into the terminal accommodating chamber 13 in the temporary locking state, a terminal 30A of the middle stage of the terminal 30 and a terminal 30B of the lower stage thereof are completely inserted into the predetermined position but a terminal 30C of the upper stage thereof is not inserted into the predetermined position as shown in FIG. 3. At this time, the locking projection 16A formed on the upper front portion of the terminal accommodating chamber 15 of the retainer 10 is brought into contact with a box 31 projecting upwardly from the terminal 30C while the locking projections 16A and 16B do not contact the box 31 of the terminals 30A and 30B. Therefore, even though an operator tries to insert the retainer 10 into the predetermined position by pressing it 10 downwardly in this state, the operator feels a resistance because the locking projection 16A is in contact with the box 31. Thus, the operator detects that the terminal 30 has not been inserted into the predetermined position.

Figure 5:
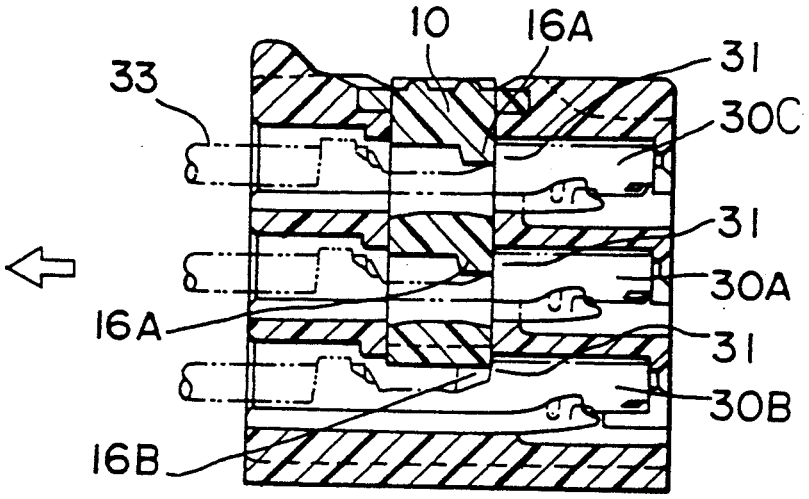
FIG. 5 is a sectional view showing a position for locking the connector according to the first embodiment of the present invention.
Figure 6:
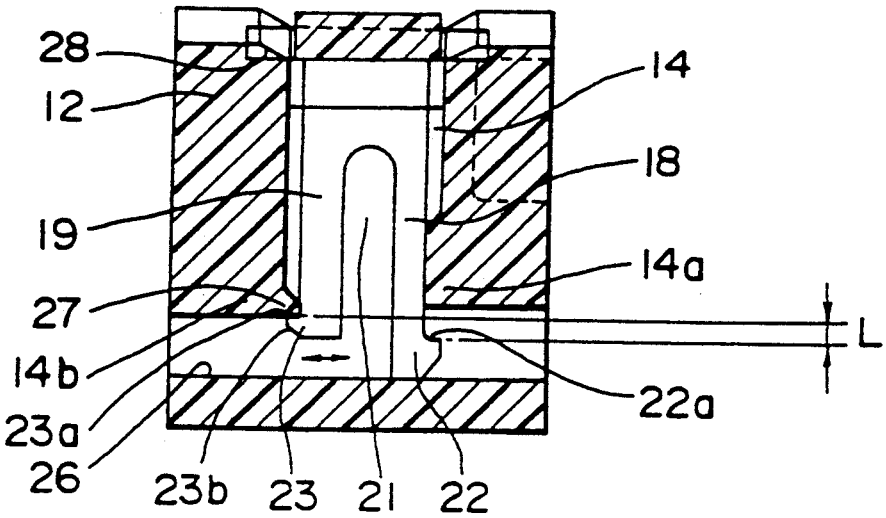
FIG. 6 is a sectional view showing a position for locking the connector according to the first embodiment of the present invention.

The retainer 10 is pressed downwardly after the state in which the terminal 30c can be inserted is obtained as shown in FIGS. 5 and 6. During the press-down operation, the locking projection 19 is flexed toward the space 21 and moves downwardly with the tapered surface 23b of the claw 23 inclining along the locking projection 27. When the tapered surface 23b moves away from the locking projection 27, the locking projection 19 which has been flexed inwardly returns to the original posture and the lower end surface of the locking projection 27 engages the claw 23, thus clicking. Thus, the operator can confirm that the retainer 10 has been inserted into the predetermined position.

When the retainer 10 is in position, the locking projections 16A and 16B of the terminal accommodating chamber 15 are in contact with the rear surface of the box 31 of the terminal 30, thus locking the terminal 30. That is, even though an electric wire 33 connected with the terminal 30 is pulled in the direction shown by an arrow of FIG. 5, the locking projections 16A and 16B prevent the movement of the terminal 30 because the locking projections 16A and 16B lock the box 31 of the terminal 30.

In removing the terminal 30 from the connector 11, a jig (not shown) is inserted from the groove 26 into the connector housing 12 to flex the locking plates 18 and 19. As a result, the locking plates 18 and 19 disengage from the lower edges 14a and 14b, respectively. At this time, the projection 24 formed on the upper surface 10d of the retainer 10 is gripped. Otherwise, the jig is inserted into the tapered surface 24a disposed below the projection 24. Thus, the retainer 10 is removed from the connector housing 12.

Figure 7:
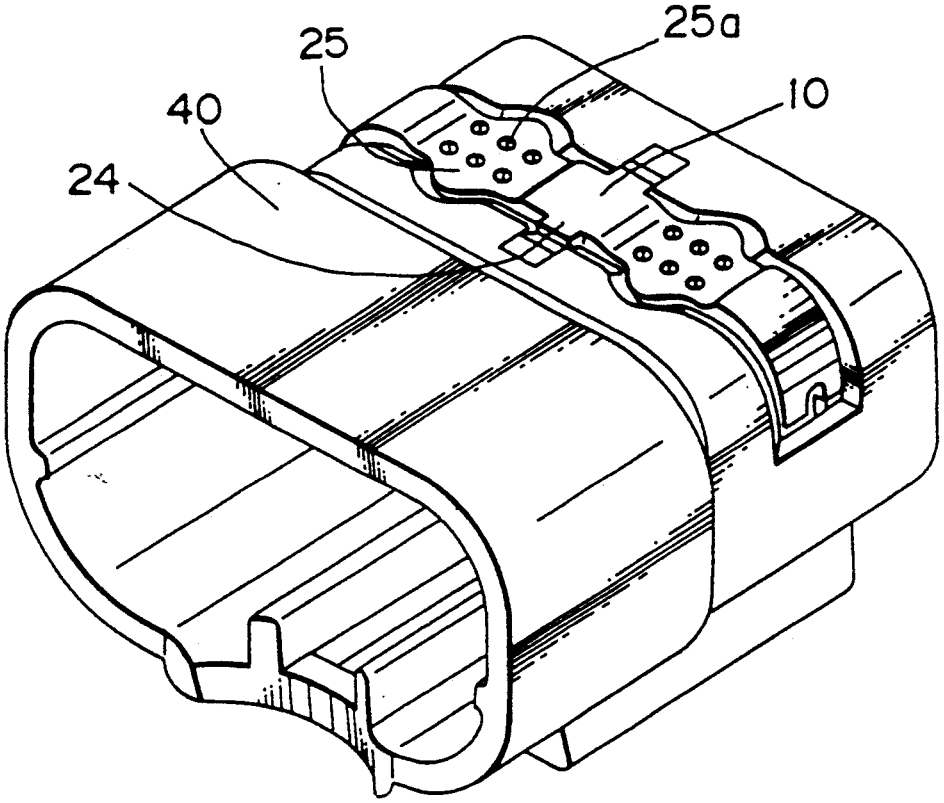
FIG. 7 is a perspective view showing a connector according to a second embodiment of the present invention.
Figure 8:
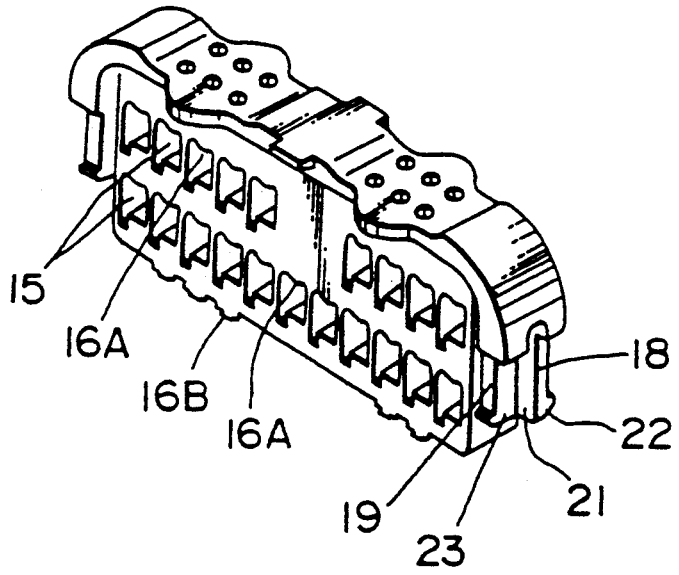
FIG. 8 is a perspective view showing a retainer according to the second embodiment of the present invention.
Figure 9:
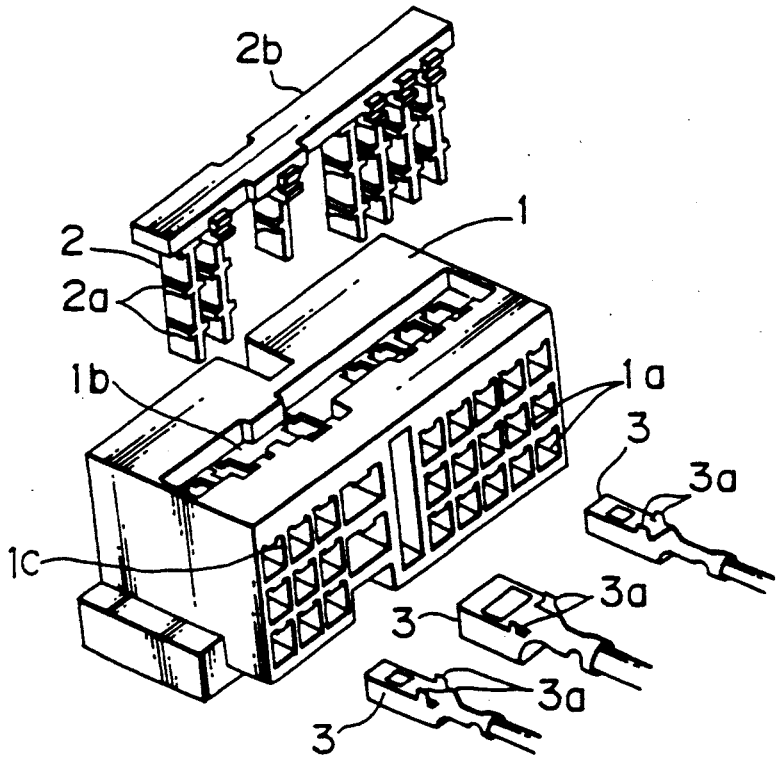
Fig. 9 PRIOR ART
FIG. 9 is an exploded perspective view showing a conventional connector.
Figure 10:
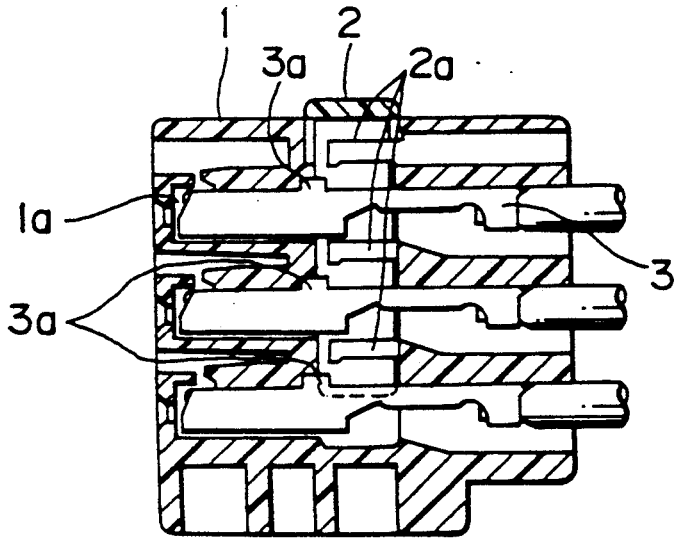
Fig. 10 PRIOR ART
FIG. 10 is a sectional view showing a position for temporarily locking the connector of FIG. 9.
Figure 11:
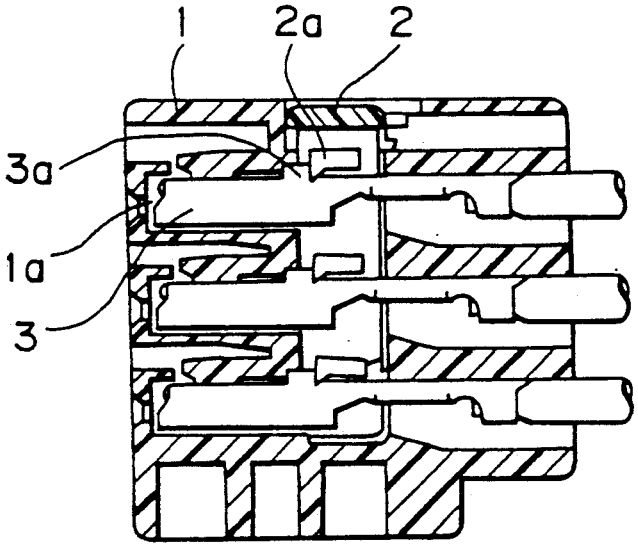
Fig. 11 PRIOR ART
FIG. 11 is a sectional view showing a position for locking the connector of FIG. 10.

According to a second embodiment of the present invention, a retainer for locking a terminal is formed on a female connector 40 which engages the male connector 11, as shown in FIGS. 7 and 8.

As apparent from the foregoing description, there is provided a connector comprising: a retainer inserting portion concaved at the upper surface of a connector housing from one side surface thereof to the other side surface thereof; a retainer, for locking a terminal, removably inserted into the retainer inserting portion; and a flexible main locking plate and a flexible temporary locking plate, longer than the main locking plate, both disposed on at least one lateral side of the retainer. In this construction, the locking portion disposed in the lower end portion of the temporary locking plate is locked at a temporary locking position by one of lower edges disposed on the lower front and lower rear of the opening of the retainer inserting portion, and the locking portion disposed at the lower end portion of the main locking plate is locked at a locking position by the other lower edge of the retainer inserting portion by pressing the retainer into the connector housing. Therefore, the operator can confirm that the retainer 10 has been inserted into the predetermined position.

Each of a plurality of terminal inserting chambers of the retainer communicates with a corresponding terminal inserting chamber of the connector housing at the temporary locking position, and the terminal inserting chambers of the retainer each having a locking projection, for locking the terminal, formed on the upper wall thereof are surrounded with a lattice-shaped frame; when the retainer is pressed downwardly to place the retainer at the locking position with the terminal inserted into the terminal accommodating chamber of the connector housing and that of the retainer, the locking projection locks a box projecting from the terminal.

Since the retainer has a lattice-shaped frame, the retainer is more rigid and stronger than the conventional retainer which is comb-shaped. Thus, even though electric wires mounted on the terminal are pulled, the terminal can be prevented from being removed from the connector housing. In addition, the retainer can be molded easily because it has the lattice-shaped frame.

Further, if the terminal has not been inserted into the terminal accommodating chamber at a predetermined position of the connector, the locking projection of the retainer interferes with the terminal. Thus, the operator detects that the retainer has not been inserted into the predetermined position.

In removing the terminal from the connector, the repair projection which is formed on the upper surface of the retainer and can be gripped when the retainer is in the connector housing. The tapered surface of the repair projection is capable of easily engaging a jig. Thus, the retainer can be easily removed from the connector housing.

What is claimed is:

1. A connector comprising:

a connector housing having at least one terminal accommodating chamber formed therethrough, said connector housing further including an upper surface, a bottom surface and opposite lateral side surfaces;

a retainer inserting opening concaved at the upper surface of said connector housing from one lateral side surface thereof to the other lateral side surface thereof, said retainer inserting opening being perpendicular to said at least one terminal accommodating chamber;

a retainer, for locking at least one terminal within a corresponding terminal accommodating chamber, removably inserted into said retainer inserting opening; and a flexible main locking plate and a flexible temporary locking plate, which is longer than said main locking plate, both disposed on at least one lateral side of said retainer, in which:

a temporary locking portion disposed at a lower end portion of said temporary locking plate is locked at a temporary locking position by one of two lower edges disposed on a lower front and a lower rear portion of said retainer inserting opening, and a main locking portion disposed at a lower end portion of said main locking plate is locked at a final locking position by the other lower edge of said retainer inserting opening by pressing said retainer into said connector housing.

2. The connector as defined in claim 2, wherein said retainer includes a lattice-shaped frame defining a plurality of terminal inserting chambers, each of said terminal inserting chambers of said retainer communicating with a corresponding terminal accommodating chamber of said connector housing at said temporary locking position, and said terminal inserting chambers of said retainer each having a locking projection, for locking a corresponding terminal, formed on an upper wall thereof; such that when said retainer is pressed downwardly to place said retainer at said final locking position with the at least one terminal inserted into a corresponding terminal accommodating chamber of said connector housing and corresponding terminal inserting chamber of said retainer, said main locking projection locks a box projecting from the at least one terminal.

3. The connector as defined in claim 1 or 2, wherein a repair projection, which is gripped when said retainer is removed from said connector housing, is formed on an upper surface of said retainer.

4. The connector as defined in claim 1, further comprising an additional flexible main locking plate and an additional flexible temporary locking plate disposed on the opposite lateral side of said retainer.

5. The connector as defined in claim 1, wherein said flexible main locking plate and said flexible temporary locking plate are joined together at one end so as to form a one-piece, U-shaped member which projects downwardly from said at least one lateral side of said retainer.

* * * * *